US006259363B1

(12) United States Patent
Payne

(10) Patent No.: US 6,259,363 B1
(45) Date of Patent: Jul. 10, 2001

(54) DETECTOR REMOVAL SIGNALLING DEVICE

(75) Inventor: Roger Dennis Payne, Havant (GB)

(73) Assignee: Apollo Fire Detectors Limited, Hampshire (GB)

( * ) Notice: Subject to any disclaimer, the term of this patent is extended or adjusted under 35 U.S.C. 154(b) by 0 days.

(21) Appl. No.: 09/306,873

(22) Filed: May 7, 1999

(30) Foreign Application Priority Data

May 20, 1998 (GB) ..... 9810900

(51) Int. Cl.[7] ..... G08B 29/00

(52) U.S. Cl. ..... 340/506; 340/505; 340/508; 340/509; 340/512; 340/514; 340/628; 340/693.5; 340/693.9; 340/693.12

(58) Field of Search ..... 340/506, 505, 340/508, 509, 511, 512, 514, 628, 693.5, 693.6, 693.9, 693.11, 693.12

(56) References Cited

U.S. PATENT DOCUMENTS

| | | | | |
|---|---|---|---|---|
| 3,978,461 | | 8/1976 | DeLime, III . | |
| 4,017,852 | | 4/1977 | Kabat . | |
| 4,369,435 | * | 1/1983 | Adachi et al. | 340/506 |
| 4,435,698 | | 3/1984 | Klett . | |
| 5,128,653 | * | 7/1992 | Yuchi | 340/506 |
| 5,440,293 | | 8/1995 | Tice . | |

FOREIGN PATENT DOCUMENTS

| | | |
|---|---|---|
| 1 319 615 | 9/1970 | (GB) . |
| 2 055 236 | 7/1980 | (GB) . |
| 2 101 784 | 6/1981 | (GB) . |
| 2 069 205 | 8/1981 | (GB) . |
| 2 203 276 | 10/1988 | (GB) . |
| 2 281 995 | 3/1995 | (GB) . |
| 2 313 690 | 12/1997 | (GB) . |

* cited by examiner

*Primary Examiner*—Donnie L. Crosland
(74) *Attorney, Agent, or Firm*—R. Lewis Gable; Cowan, Liebowitz & Latman, PC

(57) ABSTRACT

A signalling device applies a pulsating signal to supply lines when a head is removed from a base. A monitoring system includes a plurality of such signalling devices and is responsive to the pulsating signal to indicate the absence of a head from its base. When a pulsating signal is already on the supply lines, its waveform is preserved independently of the number of heads removed from respective bases. A timer is triggered either to ensure synchronisation of pulsating signals generated by two or more bases, or to prevent any second base from generating a pulsating signal, if a first base is already generating one. The timer can be an oscillator where a capacitor is prematurely discharged by a pulsating signal already present on the supply lines. The base can include additional means for inhibiting the pulsating signal when a voltage applied to the signalling device either exceeds a predetermined threshold, or changes in polarity, or both. An end of line device can be used to connect a load across the lines if a head is removed and to disconnect the load from the lines if the voltage rises above a threshold. A signalling device is also described which signals a fault if a head of one type is inadvertently fitted to a base which requires a different type. The invention can be used in fire detection systems.

28 Claims, 8 Drawing Sheets

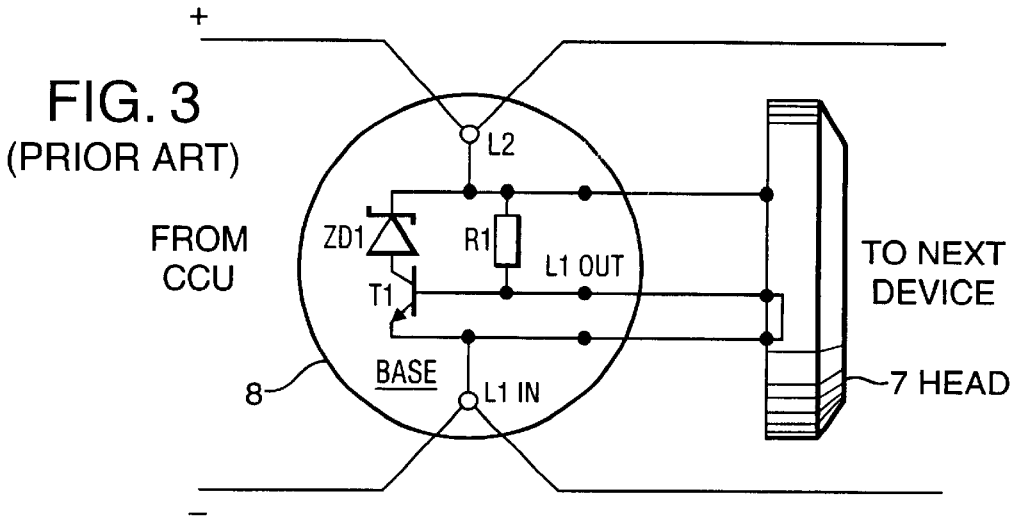
FIG. 3
(PRIOR ART)
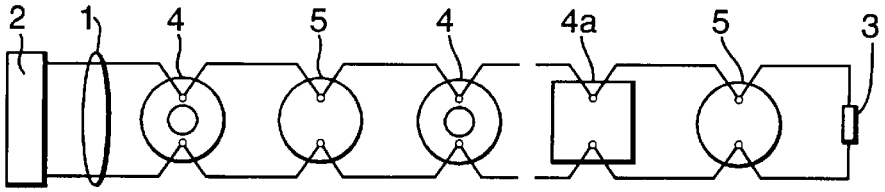
FIG. 4 (PRIOR ART)
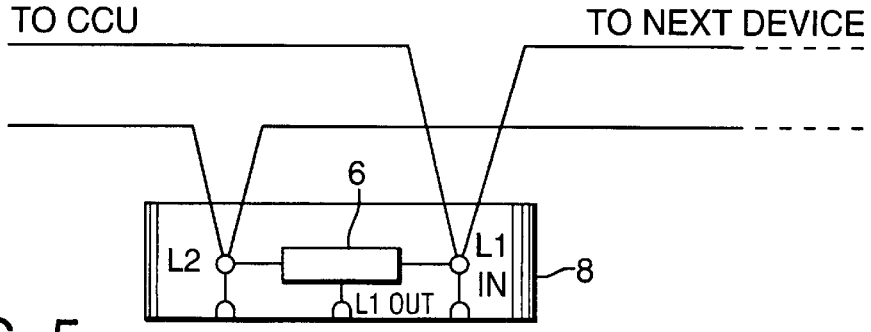
FIG. 5
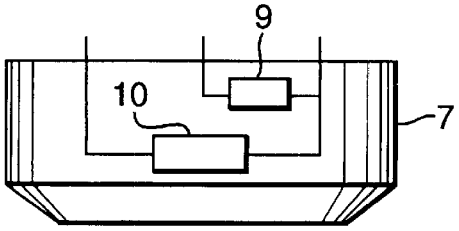

DETECTOR REMOVAL SIGNALLING DEVICE

This invention relates to a signalling device and to a monitoring system. The signalling device is of the kind having a head which is removable from a base and which includes signalling means for applying a pulsating signal to supply lines when the head is removed. The monitoring system includes a plurality of such signalling devices and monitoring means responsive to the pulsating signal to indicate the absence of a head from its base. The invention can be used in the field or fire detection where, for example, fire detectors (i.e. signalling devices) are placed in different locations in a fire detecting system (i.e. monitoring system) for signalling a change in a parameter, thereby causing an alarm signal to be given. The invention is then used for signalling that the head of a fire detector has been removed in the system. The signalling device may also be an alarm device having a sounder head which can be removed from a base, the invention similarly being used to indicate head removal. The term "signalling device" is therefore used broadly to cover any kind of unit which can be used for signalling and where some function may be impaired by head removal. Although the invention is particularly useful in the field of fire detection, references to such use are not to be construed as limiting.

BACKGROUND PRIOR ART

A centrally controlled fire alarm system can comprise a "central control unit" (or CCU) for monitoring different groups of fire detecting devices located in different parts of a building. Each group of fire detecting devices can be connected across a common pair of supply lines which are linked back to the CCU which normally applies say 12 volts to the lines to operate the detecting devices. Alarm devices, which are triggered by a higher voltage, can be connected across the same pair of common supply lines and the CCU can respond to a "fire detection signal" to apply say 24 volts to the lines so a to cause the alarm devices to give "alarm signals". This system avoids an excessive amount of wiring compared with a system where detecting devices and alarm devices are connected to respective dedicated supply lines. When such a system is in a standby condition, the supply voltage is below a threshold of, for example, 18 volts, and each fire detection device has a high line impedance, thereby drawing little or no current from the supply. On detecting a fire, the fire detecting device produces a detection signal by changing from a high line impedance to a low line impedance, for example, by switching a known resistance across the supply lines. The detection signal is detected by a control unit which then applies the higher voltage (24 v) to the lines. As the threshold voltage is then exceeded, the alarm devices are activated to produce warning signals. Such a system is disclosed in our copending UK application no. 9808094.8 to which reference may be made for further details. Alternatively or additionally, an alarm device may produce a warning signal when the polarity of the supply is reversed.

Where a fire alarm system is used to protect life or property, national regulations or codes of practice usually require the supply lines connecting the detection and alarm devices to the CCU to be monitored for an open circuit fault condition and for such fault condition to be indicated and a fault warning given at the CCU. Some regulations also require the supply lines to be monitored for a short circuit fault and for such fault to be indicted at the CCU. By connecting an "end of line device", for example a resistor, across the remote end of the supply lines so as to establish a known current in the supply lines, the CCU can indicate a fault when the current in the supply lines is abnormally low or high.

Where, to facilitate servicing, fire detectors comprise a detector head which is easily detachable from a mounting base fitted with terminals for connection to supply lines, regulations normally require that the CCU indicates a fault condition when a detector head is removed. This requirement may be met by causing the detector head to open circuit one of the supply lines when it is detached from the mounting base, thereby causing the CCU to indicate a fault condition in response to a supply line open circuit.

FIG. 1 shows a typical wiring arrangement of supply lines from a CCU to fire detector mounting bases (8) and alarm devices. When a detector head is attached to a mounting base a conducting path is completed between terminals L1 IN and L1 OUT via electrically connected corresponding terminals on the detector head that engage with terminals L1 IN and L1 OUT. A further terminal on the detecting head engages with mounting base terminal L2 thereby completing the supply connection to the detector head.

The arrangement shown in FIG. 1 has the disadvantage that removal of a detector head open-circuits a supply line to detection devices and alarm devices further away from the CCU than the detector head removed, thereby rendering those devices inoperative and parts of the building unprotected. Under some regulations this arrangement is not permitted, particularly if an alarm device or a manually operated detection device (manual call point) is rendered inoperative by the removal of a detector head. This problem can be overcome by connecting all alarm devices and manual call points closer to the CCU than any detecting device with a detachable detector head. However this approach uses excessive wiring if the optimum positioning of detection devices, manual call points and alarm devices is not to be compromised.

FIG. 2 shows an alternative wiring arrangement in which mounting base terminals L1 IN and L1 OUT are permanently connected by a diode (D1). When the detector head is attached to the base (8) the diode is short-circuited by the conducting path through the detector head linking L1 IN and L1 OUT. When the detector head is removed the diode maintains a conducting path between terminals L1 IN and L1 OUT, the diode being connected so as to maintain the supply of power to detection devices and alarm devices beyond the point where the detector head was removed. Because an open circuit is not introduced by removal of a detector head, means must be provided for the presence of a diode in the supply line to be detected in order for the removal of a detector head to be detected and a fault indicated at the CCU.

Monitoring for detector removal using the diode means described above has limitations. Firstly, the removal of a detector head produces a voltage drop, equal to the forward bias voltage of the diode D1, in the supply to detection devices and alarm devices beyond the point at which the head was removed. As more heads are removed the voltage supplied to devices near the remote end of the supply lines progressively decreases. For example, if 20 heads are removed, the decrease would be typically greater than 10 volts for general purpose silicon diodes, and over 5 volts for Schottky diodes. This limits the number of detector heads that can be removed without reducing the supply voltage below the minimum operating voltage of the alarm devices and the remaining detection devices, including manual call points. A second limitation is that where detection devices and alarm devices are connected to the same pair of supply lines, both device types must be operated in the same polarity.

GB-A-2069205 discloses other means for detecting detector head removal without interrupting the supply to detection devices and alarm devices or introducing a diode in a supply line. FIG. 3 shows a typical wiring arrangement in which the lines between detection devices are continuous and not broken by the removal of a detector head (7). FIG. 3 also shows circuit means incorporated in the base (8) of each detection device. When the head (7) is attached to the base (8), the transistor T1 is turned off and the circuit presents a high line impedance. When the detector head is removed, the short circuit that existed between the base and emitter of T1, via head and base interconnecting terminals L1 IN and L1 OUT, is broken and T1 conducts and connects a load, a zener diode ZD1, across the line. The consequent reduction in line voltage is detected by the CCU and interpreted as a detector removed fault and indicated accordingly. In systems using the disclosed means, alarm devices are either connected to separate dedicated lines or to the same lines as the detection devices and activated by reversing the polarity of the supply. Activating alarm devices by increasing the supply voltage above a threshold voltage is not practical because a zener diode connected across supply lines at any device with a head removed prevents an increase in supply voltage.

GB-A-2313690 describes another such system. Each detection devices comprises a circuit arranged to periodically connect a load across the supply lines in order to produce a fault signal and a switch which activates the circuit when the head of the device is removed. A monitoring circuit in the CCU triggers a fault warning alarm when a fault signal is detected. This arrangement has the following disadvantages or limitations:

(1) The fault signal produced by the removal of a head (i.e. periodic application of a load), would increase the current drawn from the supply if the supply voltage was switched from a low voltage (12 volts) current limited supply (25 mA) to a higher voltage, higher current limited supply (e.g. 24 volts, 1 amp) for the purpose of activating voltage threshold controlled alarm devices. This would increase the capacity and cost of any standby battery supply for the system. This problem is exacerbated by the removal of a multiplicity of detector heads.

(2) When a multiplicity of heads are removed the multiplicity of fault signals applied to the supply lines can cause perceptible interference on the output of some types of alarm devices. (For example, the alarm devices may thereby produce intermittent audible sounds).

(3) When a multiplicity of heads are removed there is a possibility that their respective fault signals will be generated so that their loads are simultaneously connected across the lines causing undesirable high current surges to be drawn from the low impedance supply for the alarm devices.

(4) When a multiplicity of heads are removed there is a possibility that fault signals applied to the lines by different devices will either overlap or be close together in time as to effectively extended the period for which a load is applied. The circuit means in the CCU monitoring for a detector removed fault signal must therefore be able to distinguish between extended signals and a fire detection signal thereby delaying detection of a fire detection signal.

(5) Overlapping fault signals can reduce the supply voltage to a low level for a time sufficient to reset a fire detection signal produced by some types of detection devices. A fire detection signal produced by many types of detection device will be reset by a supply interruption of less than 20 milliseconds without the fire detection being reset.

These limitations are so significant that alarm devices may not be connected in parallel with detection devices. For instance, FIG. 1 of GB-A-2313690 indicates that the supply to alarm devices is provided by a separate pair of lines, even when detection and alarm devices are combined in one device.

Despite all of these various attempts in the past to solve the problem of detecting removal of a plurality of detector heads, no solution has been found which does not in some way have a serious limitation.

OBJECTS OF INVENTION

An object of the invention is to provide a satisfactory solution to the above noted problems of the prior art.

A further object is to provide a system where there are a plurality of signalling devices, each with removable heads, and an unchanging fault signal is produced no matter how many heads are removed. This enables a fault signal to be reliably recognised in a multi-head system where several heads may be detached at the same time.

Another object is to provide such a system which is operable in either polarity.

A further related object is to provide such a system wherein the supply voltage can be increased (in either polarity) to activate voltage threshold dependent alarm devices.

Another object is to ensure synchronisation between the pulsating signals produced by respective signalling devices (from which heads have been removed).

SUMMARY OF INVENTION

According to one aspect of the present invention, there is provided a signalling device comprising a head which can be removably fitted to a base; the base having terminals for connection to supply lines and including signalling circuitry for applying a pulsating signal to the terminals when the head is removed from the base; the signalling circuitry also being operative, when a pulsating signal is already on the supply lines, substantially to preserve the waveform of the pulsating signal on the supply lines, whereby the pulse waveform is independent of the number of heads removed from respective bases.

The present invention also provides a monitoring system comprising a plurality of the latter-mentioned signalling devices, and a monitoring unit responsive to the pulsating signal on the supply lines, to indicate the absence of the head from its base.

An advantage of the latter aspect of the invention is that the waveform of the pulsating signal is preserved independently of the number of heads removed from respective bases. Hence an initial pulsating signal is not corrupted when several heads have been removed and each respective base is in a fault condition (in the prior art several pulsating signals can be generated at any time and can interfere with one another causing difficulty in recognising a fault signal. The invention facilitates detection of the fault signal and ensures that it can be more reliably detected.

According to one preferred embodiment of the invention, the signalling circuitry in each base, which produces the pulsating signal, includes some form of timer triggered to ensure synchronisation of pulsating signals generated by two or more bases. Alternatively, the timer is triggered to prevent any second base from generating a pulsating signal, if a first base is already supplying such a signal to the supply lines. The timer may be part of an oscillator having charge storage means, such as a capacitor, that is prematurely discharged by a pulsating signal already present on the supply lines.

In the embodiment where the pulsating signals of two or more activated bases are synchronised, subsequent pulsating signals may be synchronised with an original pulsating signal as more and more heads are removed. However, this is not essential, because any one of the activated bases (from which a head has been removed) may produce the "master" or "dominant" pulsating signal to which the signalling circuitry of other bases is synchronised. Moreover, the dominant base can shift from signalling circuitry to signalling circuitry depending on differences in circuit installation and components. However, as the bases all have similar circuitry, it makes no difference which of them is producing the dominant pulsating signal. In order to more easily ensure synchronisation, the pulsating signal, which is produced by switching an impedance across the supply lines, is such as to drop the current limited supply to less than one half of the value of the nominal voltage applied to the lines for operating the signalling devices.

In the embodiment where any second or further base is prevented from generating a pulsating signal, if a first base is already supplying such a signal to the supply lines, the second and subsequent bases will be inhibited. However, the circuitry of each base is the same and hence any of them can be inhibited if one other base is already producing a fault signal on the line. The signalling circuitry, which may include an oscillator, is preferably decoupled from the rest of the circuit in the base to prevent synchronisation between two or more activated bases.

Preferably, the base includes additional circuitry for inhibiting the pulsating signal when a voltage applied to the signalling device either exceeds a predetermined threshold, or changes in polarity, or both. However, this feature can be used independently of the means which preserves the waveform of the pulsating signal on the supply lines.

According to a second aspect of the invention, a signalling device comprises a head which can be removably fitted to a base; the base including terminals for connection to supply lines, signalling circuitry for applying a pulsating signal to the terminals when the head is removed from the base, and additional circuitry for inhibiting the pulsating signal when a voltage applied to the signalling device either exceeds a predetermined threshold, or changes in polarity, or both.

The latter aspect is useful where the line voltage is increased, or changed in polarity, or both, to operate (e.g.) alarm devices after a fire has been detected. For example, when a sensor, such as a smoke detector, has responded to fire and produced a change of state signal to cause a detection signal to be placed on the lines, a central control unit (CCU) then increases the voltage on the supply lines to operate alarm devices for sounding an alarm. An example of such a system is described in a co-pending UK Patent Application No. 9808094.8. Instead of increasing the line voltage to sound alarm devices, the polarity of the line voltage may be changed. In this case, the detecting devices can operate with either polarity applied to the lines, but if a fire is detected, the central control unit changes the polarity of the voltage applied to the lines in order to operate the alarm devices which are unipolar). There may also be a mixture of alarm devices, some of which respond to an increased voltage, and others to a change in polarity. Also, alarm devices can be supplied on lines other than those to which the detecting devices are connected.

Generally speaking, the duty cycle of the pulsating signal is preferably such that the pulse width, due to switching the impedance across the supply lines, is of a much shorter duration than the interval between pulses. In the preferred embodiment, for example, the pulse width is 10 milliseconds and the interval 5 seconds. As the pulse is very short and the waveform is preserved, current surges are avoided where several bases are producing synchronised pulsating signals and hardly any further line voltage drop is experienced beyond that due to one activated base. Even if there was more current drain as more bases were activated, this would all occur in the instant of the synchronised pulses which has a very short duration. Furthermore, the output impedance of the supply from the CCU is preferably greater than the impedance switched across the line during a pulse by one signalling devioce, so the current surge produced by synchronised pulses from any number of signalling devices would not exceed twice the surge produced by a single signalling device, thereby reducing current drain.

In order to avoid misoperation, the signalling device preferably includes charge storage means for smoothing any noise signals on the supply lines. Such noise could otherwise cause premature triggering of the timer (e.g. prematurely discharging a capacitor used for timing in an oscillator circuit).

Whilst the control unit may include a monitoring unit responsive to the pulsating signal to indicate the absence of a head from its base, an end of line device can also be used. This is connected to the end of the supply lines to return a signal to the control unit when there is no head removal fault on the lines. An advantage of using such an end of line device is that existing control units, which monitor supply lines for an open circuit by monitoring an end of line load, can employ the invention to monitor for head removal without breaking a supply line. The end of line device may be used with any other aspect of the invention or be used independently.

According to a third aspect of the invention, an end of line device comprises circuitry for connecting a load across the supply lines if a head is removed from a base, whereby said control unit detects head removal, and further including voltage threshold circuitry for disconnecting said load from the supply lines when the supply line voltage rises above predetermined threshold.

In systems where detectors are connected as shown in FIG. 5, where the removal of a head is detected when the detecting circuitry in the base detects a high impedance (9) between terminals (L1 IN, L1 OUT), one of which is a supply terminal, it is important to ensure that the supply lines from the CCU are continuous and not inadvertently connected such that the supply is open circuited when a head is removed. Such a mistake may easily be made by those more familiar with connecting bases as shown in FIGS. 1 & 2, the more so where the same base moulding is used for the detectors of FIGS. 1, 2 and 5. For example, if the line L1 OUT is inadvertently and mistakenly connected to terminal L1 IN, this wiring fault will not be detected by the CCU shown in FIG. 5, when the head is attached to the base, the head presenting a low impedance between terminals corresponding with L1 IN and L1 OUT. Consequently when the head is removed, the path from the supply line L1 to the next and following devices will be open circuit, thereby rendering these devices inoperative, in contravention of regulations, even though the CCU would detect and indicate a fault condition. To prevent such an occurrence, signalling devices according to the invention (and signalling devices intended to be connected as shown in FIG. 5) where the removal of a head is detected when detecting circuitry in the base detects a high impedance between terminals one of which is a supply terminal, can be fitted with an impedance (9) between corresponding head terminals; the impedance being of a value which is recognised by the CCU as a line fault condition, but not of such a high value as to be recognised by the head removal detecting circuitry (in the base) as a head removed condition.

According to a fourth aspect of the invention, which may be used independently of other aspects, a signalling device comprises a head which can be removably fitted to a base, the base having (a) supply terminals and at least one additional terminal, all of which terminals engage with corresponding terminals of the head when the head is fitted to the base, and (b) detecting circuitry for detecting the removal of the head when the impedance between one of said supply terminals and said additional terminal changes from a low impedance to a high impedance, the impedance in the head, connected to the respective head terminals, being of a value which can be recognised by the CCU as a line fault condition, but not recognised by said detecting circuitry in the base as a head removed condition.

In a specific preferred embodiment of the invention, a plurality of detection devices and a plurality of alarm devices are connected in parallel across a pair of supply lines connected to a CCU unit providing supply current and supply voltage. The incoming and outgoing conductors of each supply line are connected to a common terminal at each device, the supply lines being used to signal current drain in a detecting device operating when a first voltage is present on the supply lines. Alarm devices operate when a second voltage, which is higher than the first voltage and higher than a voltage threshold, is present on the supply lines. For each device that comprises a removable head and fixed mounting base, each such base is fitted with a circuitry comprising a detector and an oscillator for periodically connecting a load across the supply lines to produce a fault signal when the detector detects that the head of the device has been removed. The value of the load is determined such that the pulse part (with load connected) of the fault signal reduces the supply voltage to less than half the normal supply voltage (first voltage). The CCU monitors for the presence of the fault signal and initiates a fault warning signal when the fault signal is detected. The circuitry further comprises voltage responsive circuitry which responds to the second voltage, the second voltage being higher than a voltage threshold, so as to inhibit the circuitry from periodically connecting a load across the supply whether or not the detector has detected that the head of the device has been removed. The circuitry further comprises signal responsive circuitry which responds to any fault signal already being applied to the supply lines by either inhibiting the circuit from periodically connecting a load across the supply when a head of another device has previously been removed, or by synchronising the operation of the circuit with the operation of the circuit of the other device with its head previously removed so as to make the periodic connecting of a load across the supply by each circuit substantially coincident. The circuit therefore prevents a head removal fault signal being applied to the supply lines above a voltage threshold, and prevents more than one fault signal from being applied or being apparent on the supply lines below the voltage threshold when one or more heads are removed.

In another specific embodiment of the invention, which is similar to the first embodiment except that the fault signal is not monitored by the CCU. Instead, an end of line device (EOLD) is connected across the supply lines at or after the most remote device on the supply lines, the EOLD comprising fault circuitry for detecting the fault signal, switching circuitry responsive to the fault circuitry, the switching circuitry connecting a load across the supply lines in the absence of the fault signal and disconnecting the load in the presence of the fault signal. The load across the lines is monitored by a circuit fault monitoring unit in the CCU, the circuit fault monitoring unit producing a fault warning when the load is not connected across the lines.

An advantage of the latter embodiment is that existing CCUs, those that monitor supply lines for an open circuits by monitoring an end of line load, can be used to monitor for device removal without breaking a supply line.

DESCRIPTION OF DRAWINGS AND PREFERRED EMBODIMENTS

The attached drawings include:

FIG. 1 which shows a typical wiring arrangement of supply lines from a CCU to fire detector mounting bases and alarm devices.

FIG. 3 shows a prior art arrangement (GB-A-2069205).

FIG. 4 shows a typical wiring arrangement in which the lines between detection devices are continuous and not broken by the removal of a detector head.

FIGS. 5 and 6 show a first embodiment of the invention.

Figure 1:
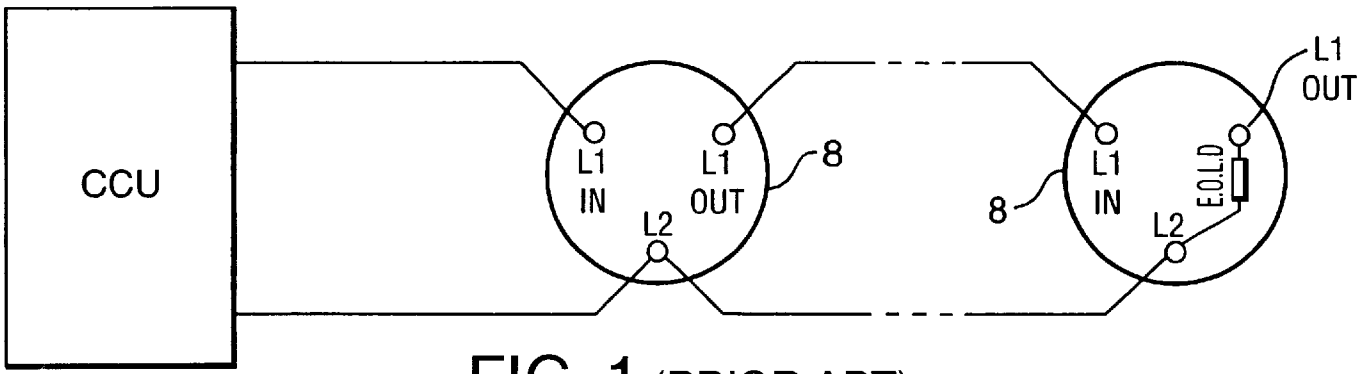
FIG. 1 (PRIOR ART)
Figure 2:
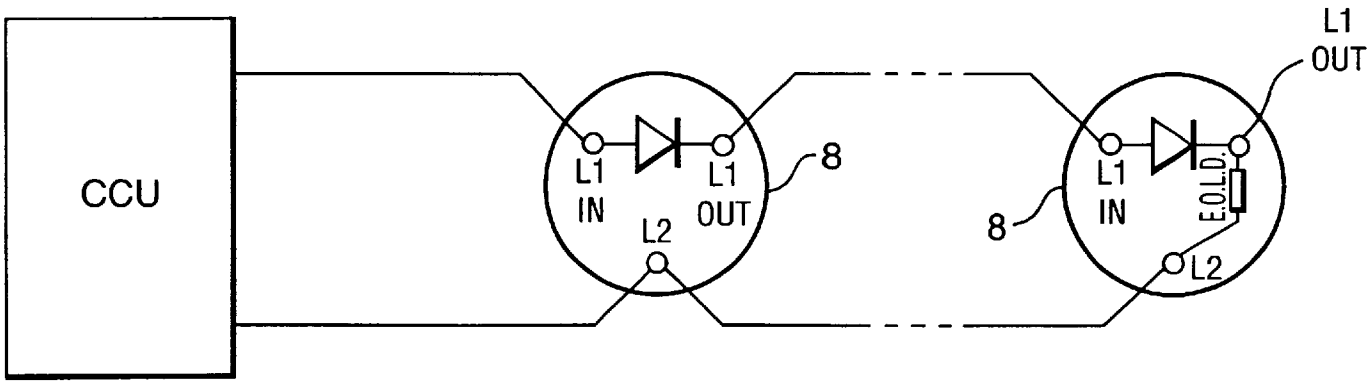
FIG. 2 (PRIOR ART)
FIG. 2 is an alternative wiring arrangement.

FIG. 4 shows a typical wiring arrangement of a prior art system which may embody the invention. Supply lines (1) are continuous from the CCU (2) to the EOLD (3) with detection devices (4), including manual call points (4A), and alarm devices (5) connected in parallel across the supply lines. Referring now to FIG. 5, at each device with a removable head (7) there is fitted in the base part (8) circuit means (6) according to the invention. In a preferred embodiment the circuit means is connected to both supply lines and a third connection is made to a supply line of either polarity via a conducting path through the head, the third connection thereby being broken when the head is removed from the base. In FIG. 5, the impedance (9) of the conducting path between the head terminals that engage with L1 IN and L1 OUT may be a short circuit, or with advantage be set to a high value, e.g. 10 k ohms, without impairing the operation of the head removal detection and signalling means disclosed in FIG. 6. A high impedance is advantageous to prevent a voltage threshold dependent head being inadvertently installed in a system of a type shown in FIGS. 1 or 2 using the same model of mounting base but without the head removal signalling circuit being incorporated. On engaging the head with the base the impedance would be connected in series with the supply lines and recognised by the CCU as a fault condition. The head (7) has sensing means and circuitry (10) for "signalling a change in a parameter" (e.g. a smoke detector and circuitry of known construction).

Figure 6:
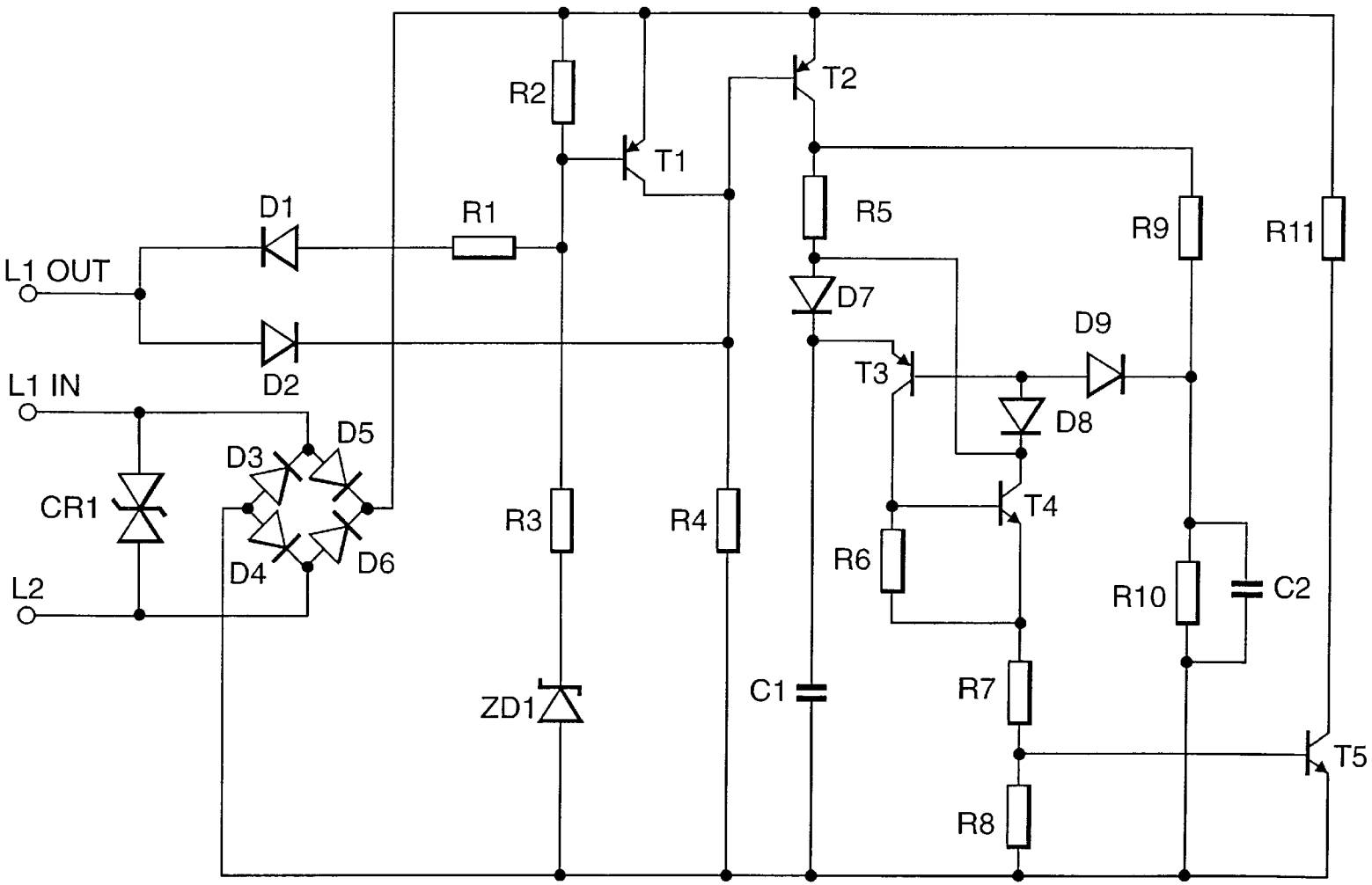

A description will now be given of a preferred embodiment of the circuit means (6). FIG. 6 is a circuit diagram of circuit means 6. The circuit comprises a bridge rectifier (D3, D4, D5, D6) which makes the device operable with a supply of either polarity, a relaxation oscillator comprising (R5, R6, R7, R8, R9, R10, C1, D7, D8, D9, T3, T4). This oscillator circuit may be replaced by a functionally equivalent circuit, e.g. a circuit based on a programmable unijunction transistor.

The oscillator is turned off when switching means T2 is off. T2 is off when T1 is turned hard on, that is when L1 OUT is connected to the negative supply line or when the rectified supply voltage is higher than a voltage threshold determined by the threshold voltage of ZD1. (As explained above, the latter condition can occur when the line voltage has been increased to operate alarm devices after a fire has been detected). An example of this system is described in our co-pending UK Application No. 9808094.8). T2 is also turned off when L1 OUT is connected to the positive supply line, the base current to T2 being shunted to the positive supply via diode D6. Therefore if neither supply line is connected to L1 OUT, i.e. the head is removed, and the supply voltage is less than the voltage threshold determined by ZD1 the oscillator will be switched on. The oscillator output turns T5 on for say 10 millisecond at 5 second intervals. When T5 is on, the low value resistor R11 is connected across the rectified supply causing the circuit means to periodically present a low line impedance. Periodic application of the low impedance across the supply lines constitutes a fault signal indicating that a head has been removed. The voltage across the supply lines will be pulsed to less than half the normal supply voltage when the output impedance of the source of supply is greater than R11.

The oscillator starts working by C1 being slowly charged (5 seconds) via R5 and D7. T3 is then turned on when the voltage on C1 exceeds a voltage threshold, the threshold voltage being the voltage at the junction of the potential divider formed by R9 and R10 plus the forward bias voltages of D9 and T3 base emitter junction. T3 turning on turns on T4 which provides positive feedback to T3 via D8. This causes C1 to be rapidly discharged for a time (10 milliseconds) controlled by the value of R7 until T3 and T4 switch off, whereupon C1 starts to charge up again. The voltage at the junction of R9 and R10 and hence the threshold voltage is for the most part proportional to the supply voltage.

If a head has been removed and C1 is being charged, C1 can be prematurely discharged by a reduction in the supply voltage that reduces the voltage threshold below the voltage on C1. This situation can occur when a head has been previously removed from another device and the circuit means (6) in that device is already applying a fault signal to the supply lines. Thus capacitors C1 in both circuit means (6) are simultaneously discharged and the two oscillators synchronise, the oscillator with the higher frequency determining the synchronised frequency. Similarly, if a multiplicity of heads are removed their fault signals will synchronise. To ensure synchronisation the pulse part of a fault signal should reduce the supply voltage to less than half the normal supply voltage (first voltage).

It is desirable to prevent capacitor C1 from being prematurely discharged by extraneous interfering sources producing transient negative voltage pulses on the supply lines. One method of achieving this is to connect a capacitor C2 across R10. The time constant of C2 and R9 and R10 in parallel is made longer than the duration of the longest expected transient, but significantly shorter than the time for which an oscillator switches a low impedance across the supply. Preferably transient protection device CR1 clamps transients to a low voltage level.

The fault signal produced by detector removal may be recognised by microprocessor means in the CCU monitoring the voltage on the supply lines. In the event that the microprocessor means recognises a fault signal on the supply lines a fault warning signal can be produced. Furthermore, where an end of line device such as a resistor is used to establish a monitoring current the fault signal produced by removal of a head may be distinguished from a line open circuit or short circuit condition.

Figure 6A:
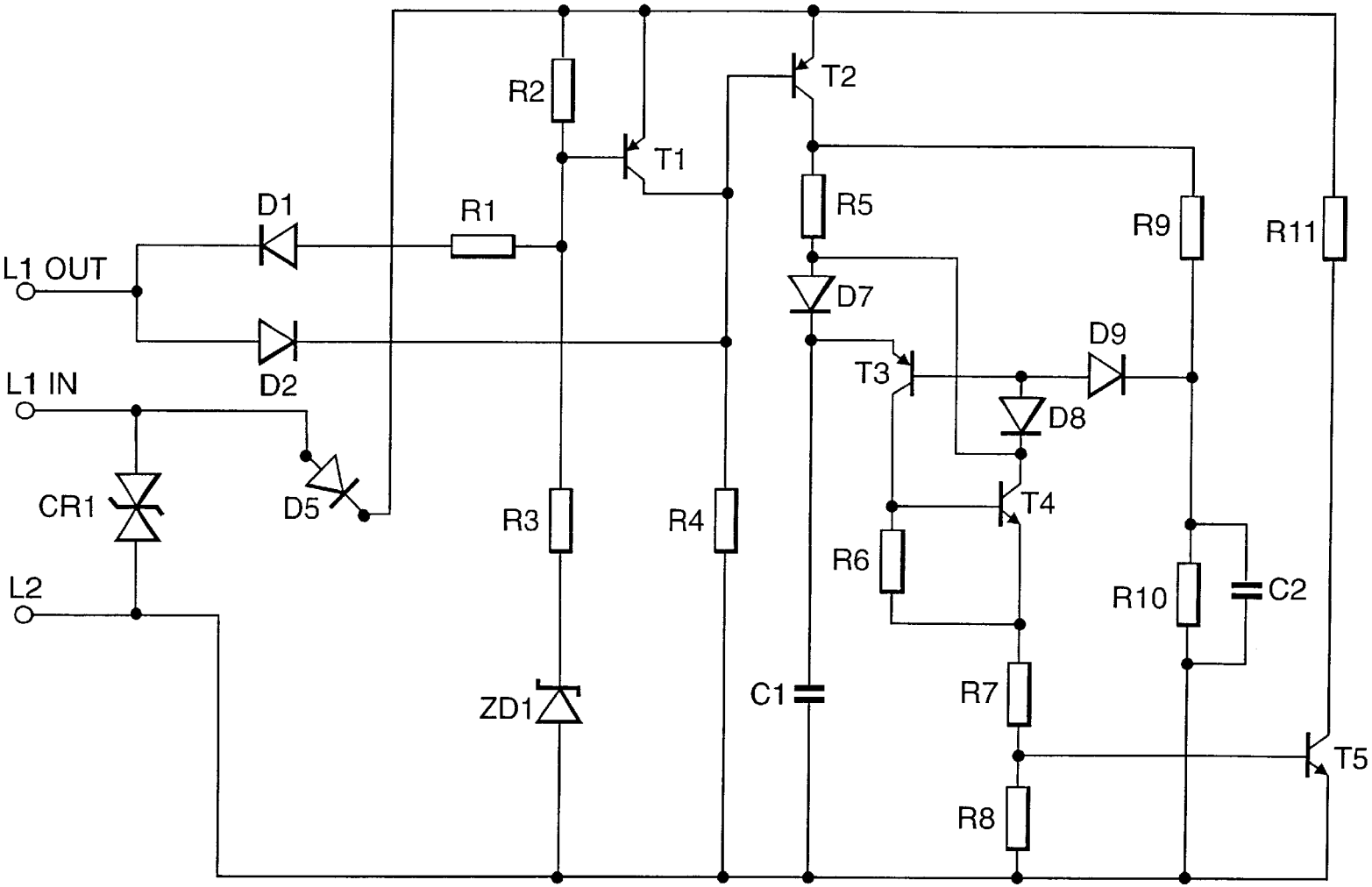
FIG. 6A shows modification of the circuit in FIG. 6.

FIG. 6A shows a modification where a diode D5 replaces the bridge rectifier (D3,D4,D5,D6), the remainder of the circuitry being the same. The circuitry of FIG. 6A can be used to inhibit the generation of a pulsating signal due to a change in the polarity of the line voltage at all line voltages. This is useful where the line voltage polarity is changed to operate alarm devices following the generation of a detecting signal (when a fire has been detected) and when the central control unit (CCU) has changed the polarity of the line voltage in order to operate the alarm devices. In this situation, it is not necessary to generate pulsating signals to indicate head removal.

Figure 7:
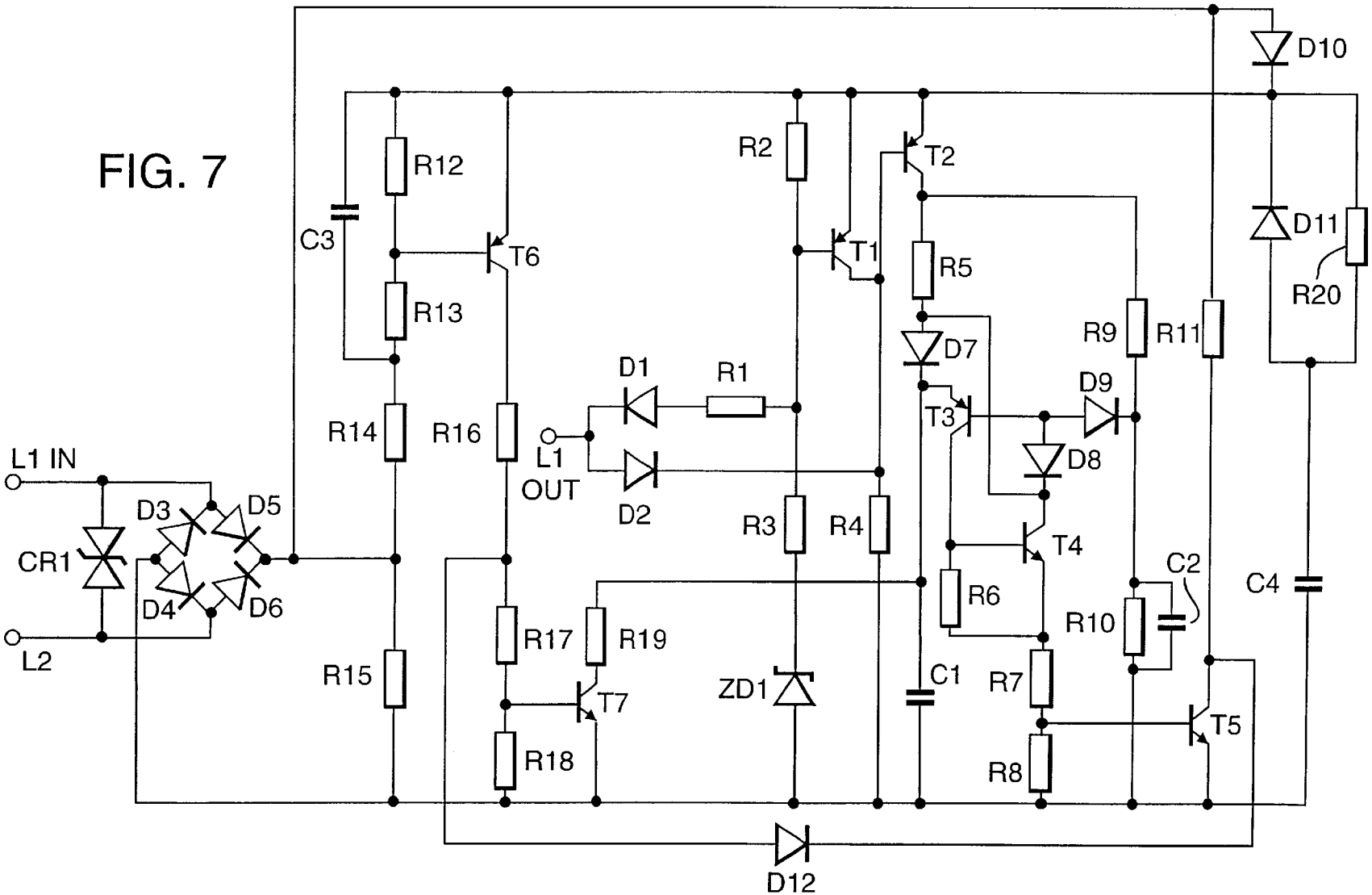
FIG. 7 shows a second embodiment of the invention.

FIG. 7 is a circuit diagram of a second preferred embodiment of circuit means (6) wherein the relaxation oscillator is decoupled from the supply lines (D11, R20, C4) so as to prevent synchronisation with oscillators in other devices with heads removed. In this embodiment circuit means (6) also comprises signal detection means (C3, R12, R13, R14, R15, R16, T6) responsive to the pulse part of a fault signal on the supply lines produced upon removal of a first head. On detection of the fault signal the signal detection means operates switching means (R17, R18, R19, T7) thereby discharging C1. Therefore, if C1 is being charged because a second or further head has been removed, the oscillator means is reset thereby preventing a second fault signal from being applied to the supply lines. Operation of switching means (R17, R18, R19, T7) is inhibited when T5 is turned on, thus preventing C1 from being discharged by a fault signal produced upon removal of a first head. It will be noted that this inhibiting means is responsive to the presence of a pulsating signal already on the lines, whereas the operation of ZD1 in this (and the embodiment of FIG. 6) is due to an increase in line voltage (to operate alarm devices, e.g. from 12 volts to 24 volts). The latter inhibiting means is therefore not the same as the former.

Inhibiting the generation of multiple head removal pulsating signal will avoid current surges and overlapping of pulses which may otherwise occur (in the prior art) on the supply lines and be potentially confused with a detection signal. For example, in practice, both of these signals may be generated by switching a low impedance across the supply lines so as to cause an increase in line current. If precautions are not taken to prevent the generation of the multiple signals due to head removal this can have an adverse effect on the detection of a pulsed or continuous current signal which represent a detection signal due to the outbreak of fire.

Figure 8:
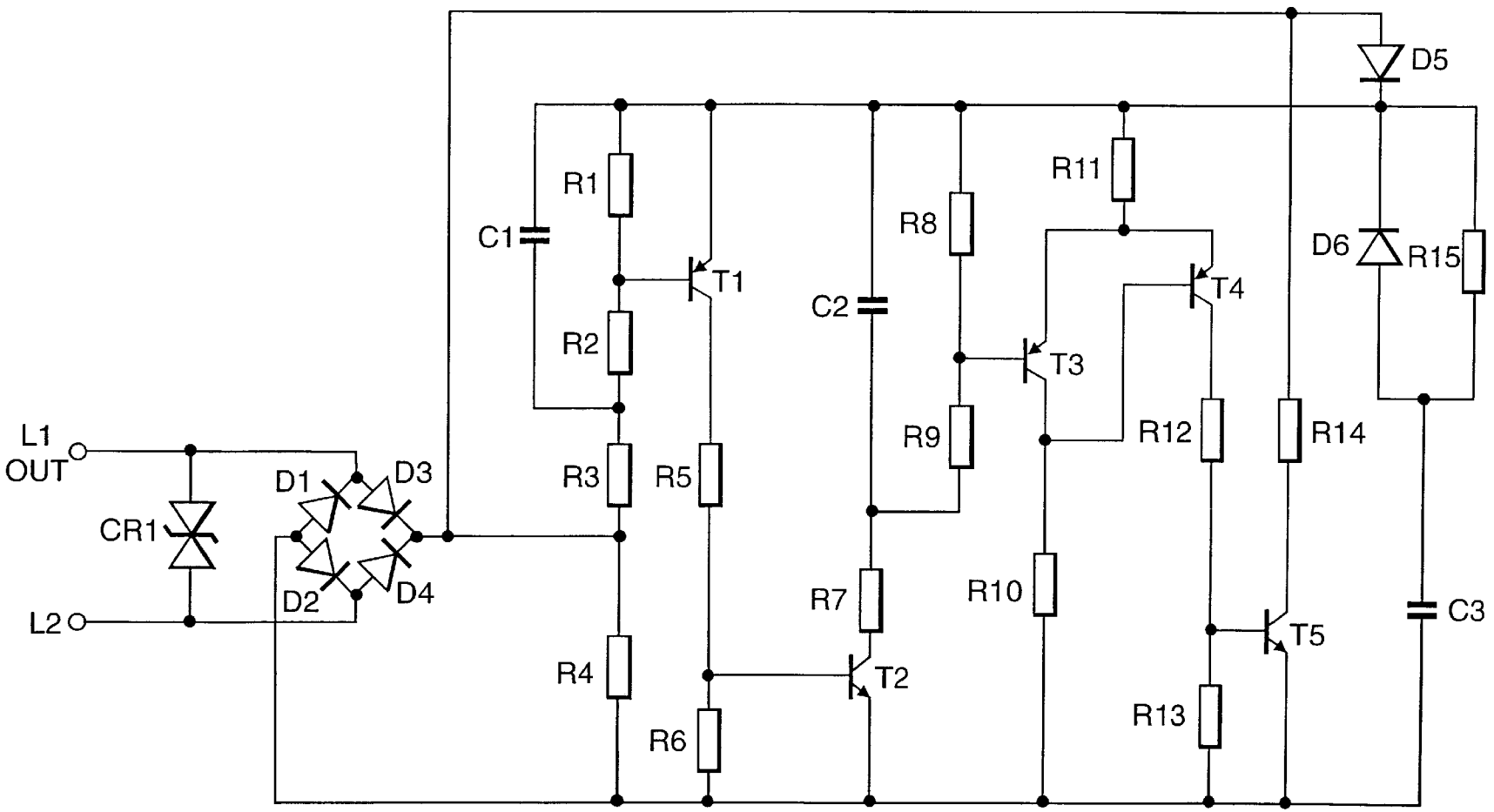
FIGS. 8–10 shows end of line devices.

FIG. 8 is a circuit diagram of an end of line device according to the invention. The circuit comprises a bridge rectifier (D1, D2, D3, D4) which makes the device operable with a supply of either polarity, and supply conditioning components (CR1, D5, D6, R15 C3). Signal detection means (R1, R2, R3, R4, R5, T1) is responsive to the pulse part of a fault signal produced by the removal of a head, and charge pump (R6, R7, T2, C2) is responsive to the signal from the signal detection means such that the voltage across C2 increases when the pulse part of a fault signal is detected. Voltage threshold sensing means (R8, R9, R10, R11, R12, R13, T3, T4) is responsive to the voltage across C2, preferably on detection of at least two fault pulses, and switching means T5 is responsive to the signal from the threshold voltage sensing means so that the load resistor (R14) is connected across the supply lines in the absence of a fault signal and is disconnected when a fault signal is present.

Figure 9:
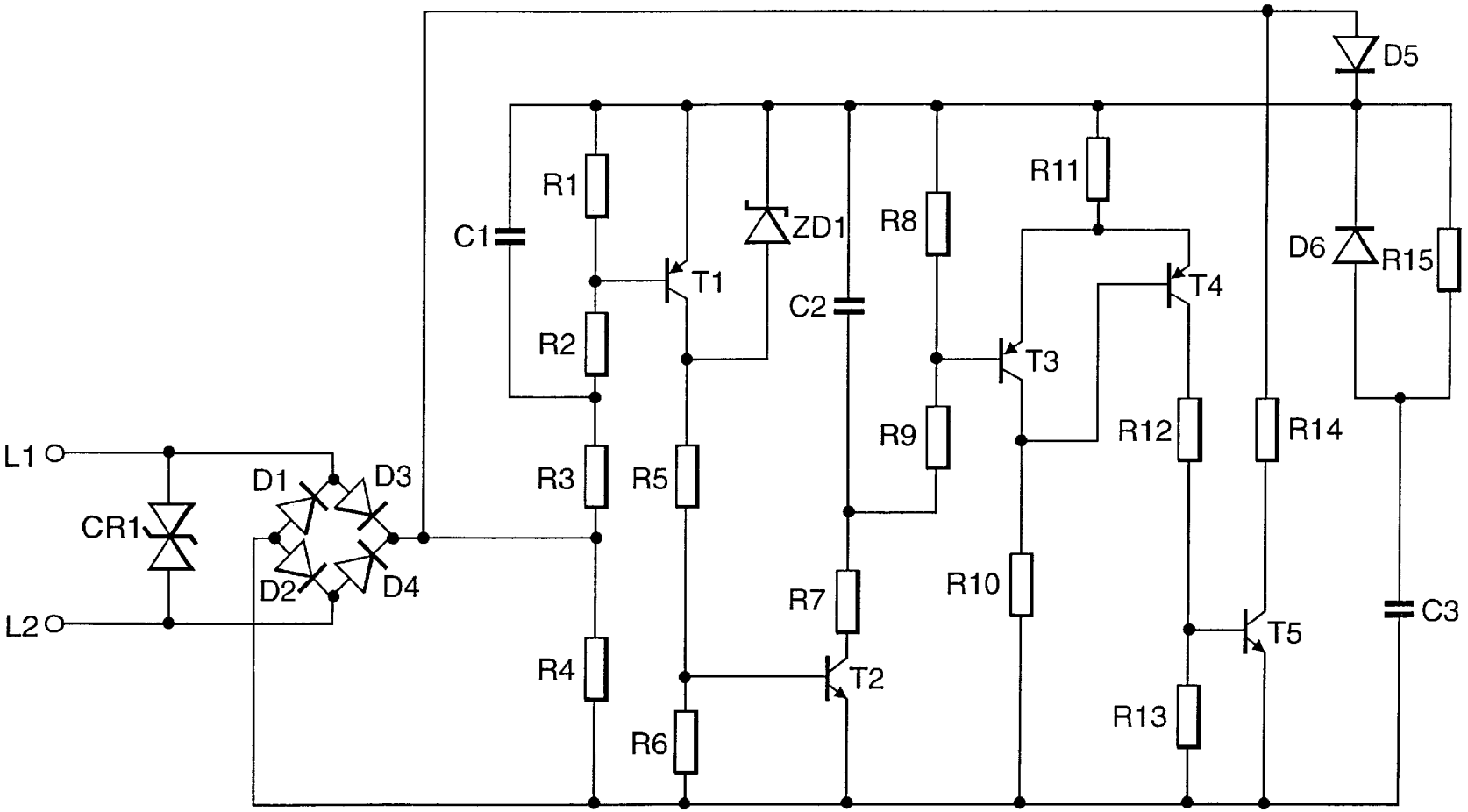

FIG. 9 is another circuit diagram of an end of line device according to the invention having the same function as the circuit shown in FIG. 8 and additionally incorporating threshold voltage sensing means (ZD1,R5,R6,T2) whereby when the supply voltage exceeds a predetermined threshold voltage, e.g. 18 volts, the load resistor R14 is disconnected from the supply by T5 switching off. Above the threshold voltage R14 is disconnected whether or not a detector head has been removed. This is advantageous because the current drain is reduced when the CCU switches the supply to a voltage higher than the voltage thresholds of both the end of line device and the alarm device so as to operate alarm devices. As fire codes do not normally require supply line or head removal monitoring when alarm devices are being operated, the required capacity of a standby battery can be reduced by disconnecting the end of line device monitoring impedance, the current drain of typical end of line monitoring impedance being roughly equivalent to the alarm drain current of a high efficiency alarm device.

Figure 10:
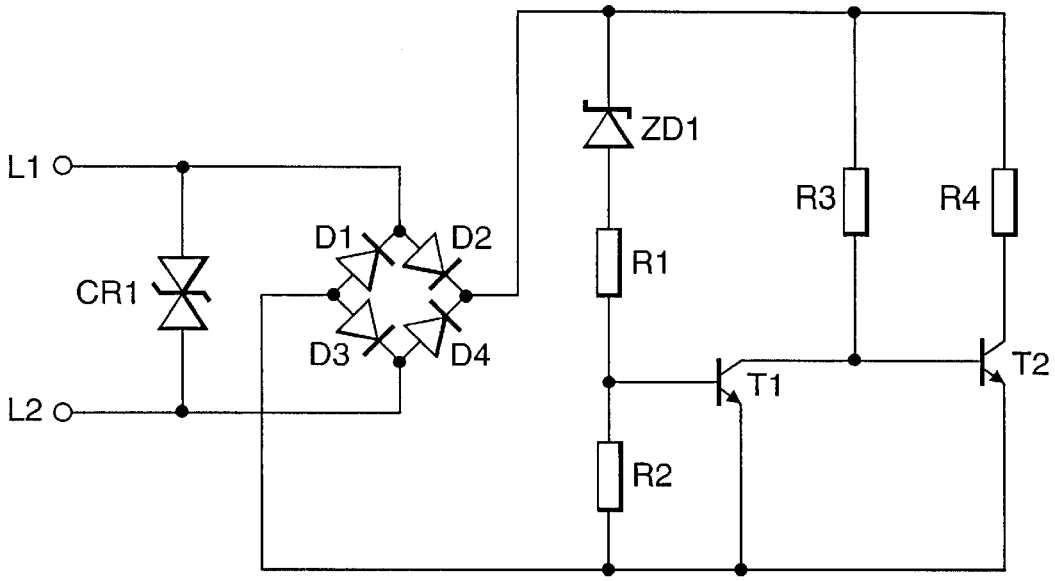

FIG. 10 is another circuit diagram of an end of line device according to the invention for use when the means for sensing head removal pulses is contained in the CCU instead of the end of line device. Again, when the supply voltage exceeds a predetermined voltage, e.g. 18 volts, threshold voltage sensing means (ZD1,R1,R2,T1) causes T2 to switch off and disconnect the load resistor R4 from the supply. This end of line device may also be used with the same advantages in systems using voltage threshold dependent alarm devices but not using the detector removal monitoring means disclosed herein.

The various features and aspects of the invention may be used independently and/or in any combination.

What is claimed is:

1. A signalling device for the use in a monitoring system, said system being connected by supply lines to a plurality of said signalling devices and having a detector responsive to a pulsating signal on the supply lines; said signalling device comprising a head which can be removably fitted to a base; the base having terminals for connection to said supply lines and including signalling circuitry for applying said pulsating signal having a waveform to the terminals when the head is removed from the base; said signalling circuitry also being operative; when another said signalling device has already applied its respective pulsating signal to said supply lines to preserve said waveform whereby said waveform is independent of a number of said heads removed from said respective bases of said signalling devices.

2. A signalling device according to claim 1, wherein the signalling circuitry includes a timer for timing the pulsating signal and which is triggered either to ensure synchronisation of the pulsating signals generated by one or more other bases, or to inhibit the generation of a pulsating signal if one is already on the supply lines.

3. A signalling device according to claim 2, wherein said timer includes an oscillator having charge storage means that is prematurely discharged in response to the pulsating signal on the supply lines either to ensure said synchronisation, or to inhibit the generation of the pulsating signal.

4. A signalling device according to claim 3, wherein said timer is prematurely reset to prevent any second base from generating a pulsating signal if a first base is already supplying a pulsating signal to the supply lines, said timer being decoupled from the rest of the circuit to prevent synchronisation of pulsating signals from a plurality of bases.

5. A signalling device according to claim 1, wherein the base includes additional inhibiting circuitry to inhibit the pulsating signal when a voltage applied to the signalling device either exceeds a predetermined threshold, or changes in polarity, or both.

6. A signalling device according to claim 5, wherein the inhibiting circuitry includes voltage threshold circuitry responsive to a line voltage exceeding a predetermined threshold.

7. A signalling device according to claim 6, wherein the inhibiting circuitry includes a diode for blocking a line voltage of a different polarity.

8. A signalling device comprising a head which can be removably fitted to a base; the base including terminals for connection to supply lines, signalling circuitry for applying a pulsating signal to the terminals when the head is removed from the base, and additional inhibiting circuitry to inhibit the pulsating signal when a voltage applied to the signalling device either exceeds a predetermined threshold, or changes in polarity, or both.

9. A signalling device according to claim 8, wherein said additional inhibiting circuitry includes voltage threshold means responsive to a line voltage exceeding a predetermined threshold.

10. A signalling device according to claim 9, wherein said additional inhibiting circuitry includes a diode for blocking a line voltage of a different polarity.

11. A monitoring system comprising:

a plurality of signalling devices connected to supply lines, each signalling device comprising a head which can be removably fitted to a base; the base having terminals for connection to said supply lines and including signalling circuitry for applying a pulsating signal to the terminals when the head is removed from the base; said signalling circuitry also being operative, when another said signalling device has already applied its respective pulsating signal to said supply lines to preserve said waveform, whereby said waveform is independent of a number of said heads removed from said respective bases of said signalling devices; and a monitoring unit responsive to the pulsating signal on the supply lines, to indicate the absence of the head from its base.

12. A system according to claim 11, wherein the response of the signalling circuitry is such as to synchronise the generation of pulsating signals from two or more bases from which the respective heads have been removed, and including a current limited supply to apply a nominal voltage to the supply lines for operating the signalling devices, each signalling device having an impedance which is switched across the supply lines to apply the pulsating signal, the value of the nominal voltage being reduced to less than half its value when the impedance is switched.

13. A system according to claim 11, wherein the duty cycle of the pulsating signal is such that the pulse due to switching said impedance across the supply lines is of a much shorter duration than the interval between pulses.

14. A system according to claim 11, wherein each signalling device includes charge storage means for smoothing any noise signals from the supply lines.

15. A system according to claim 11, wherein said signalling devices are detecting devices and wherein a control unit is connected to the supply lines for supplying a first voltage when the circuitry of each detecting device is in a quiescent state and for supplying a second voltage when the circuitry of at least one of the detecting devices is in an alarm state; alarm devices being provided which are responsive to the second voltage.

16. A system according to claim 15, wherein said control unit includes said monitoring unit responsive to the pulsating signal to indicate the absence of a head from its base.

17. A system according to claim 15, wherein said monitoring unit is an end-of-line device which is connected to the end of the supply lines to return a signal to the control unit when there is no fault on the supply lines.

18. A system according to claim 17, wherein the end-of-line device comprises detecting circuitry for the pulsating signal and switching circuitry, responsive to the output of the detecting circuitry, for disconnecting a load across the supply lines in the absence of the pulsating signal; the central control unit including means for producing a fault warning when it detects that the load is not connected across the supply lines.

19. A monitoring system comprising:

a plurality of signalling devices connected to supply lines, each signalling device comprising a head which can be removably fitted to a base; the base including terminals for connection to supply lines, signalling circuitry for applying a pulsating signal to the terminals when the head is removed from the base, and additional inhibiting circuitry to inhibit the pulsating signal when a voltage applied to the signalling device either exceeds a predetermined threshold, or changes in polarity, or both; and a monitoring unit responsive to the pulsating signal on the supply lines, to indicate the absence of the head from its base.

20. A system according to claim 19, wherein the response of the signalling circuitry is such as to synchronise the generation of pulsating signals from two or more bases from which the respective heads have been removed, and including a current limited supply to apply a nominal voltage to the supply lines for operating the signalling devices, each signalling device having an impedance which is switched across the supply lines to apply the pulsating signal, the value of the nominal voltage being reduced to less than half its value when the impedance is switched.

21. A system according to claim 19, wherein the duty cycle of the pulsating signal is such that the pulse due to switching said impedance across the supply lines is of a much shorter duration than the interval between pulses.

22. A system according to claim 19, wherein each signalling device includes charge storage means for smoothing any noise signals from the supply lines.

23. A system according to claim 19, wherein signalling devices are detecting devices and wherein a control unit is connected to the supply lines for supplying a first voltage when the circuitry of each detecting device is in a quiescent state and for supplying a second voltage when the circuitry of at least one of the detecting devices is in an alarm state; alarm devices being provided which are responsive to the second voltage.

24. A system according to claim 23, wherein said control unit includes said monitoring unit responsive to the pulsating signal to indicate the absence of a head from its base.

25. A system according to claim 23, wherein said monitoring unit is an end-of-line device which is connected to the end of the supply lines to return a signal to the control unit when there is no fault on the supply lines.

26. A system according to claim 25, wherein the end-of-line device comprises circuitry for detecting the pulsating signal and switching circuitry, responsive to the output of the detecting circuitry, for disconnecting a load across the supply lines in the absence of the pulsating signal; the central control unit including means for producing a fault warning when it detects that the load is not connected across the supply lines.

27. A signalling device for use with a system in which one or more of said signalling devices are connected via supply lines to a central control unit (CCU) comprising a head which can be removably fitted to a base, the base having (a) supply terminal and at least one additional terminal, all of which terminals engage with corresponding terminals of the head when the head is fitted to the base, an impedance connected across one of said supply terminals and said at least one additional terminal, and (b) detecting circuitry for detecting the removal of the head when said impedance changes from a low impedance to a high impedance, and wherein the head has an impedance connected to respective head terminals, which is of a value which can be recognized by said CCU as a line fault condition, but not recognized by said detecting circuitry in the base as a head removed condition.

28. An end of line device for use in a system in which a control unit is connected to supply lines for supplying signalling devices connected to the supply lines, each signalling device including a head removably fitted to a base, the control unit being capable of detecting an open circuitry in a supply line; the end of line device comprising:

switching circuitry for disconnecting a load across the supply lines if a head is removed from a base, whereby said control unit detects head removal, and further including a voltage threshold circuit for disconnecting said load from the supply lines when a voltage on said supply lines rises above a predetermined threshold.

* * * * *